United States Patent [19]

Bel Moratalla

[11] Patent Number: 4,620,194

[45] Date of Patent: Oct. 28, 1986

[54] TUNABLE ANTENNA WITH VARIABLE SERIES L-C NETWORK

[76] Inventor: Joaquin Bel Moratalla, 4 & 6 Carmen Street, Badalona (Barcelona), Spain

[21] Appl. No.: 548,574

[22] Filed: Nov. 4, 1983

[30] Foreign Application Priority Data

Nov. 16, 1982 [ES] Spain ..... 517418

[51] Int. Cl.[4] ..... H01Q 1/08; H01Q 9/04

[52] U.S. Cl. ..... 343/747; 343/745; 343/750

[58] Field of Search ..... 343/745, 747, 749–752, 343/723, 823, 873, 722

[56] References Cited

U.S. PATENT DOCUMENTS

| | | | |
|---|---|---|---|
| 2,206,820 | 7/1940 | Mydlil | 343/745 |
| 2,866,197 | 12/1958 | Kandoian | 343/745 |
| 2,993,204 | 7/1961 | Macalpine | 343/745 |
| 3,085,215 | 4/1963 | Shepheard | 343/750 |
| 3,623,113 | 11/1971 | Faigen et al. | 343/823 |
| 3,671,972 | 6/1972 | Spilsbury et al. | 343/750 |
| 3,818,488 | 6/1974 | Majkrzak et al. | 343/823 |
| 4,201,990 | 5/1980 | Altmayer | 343/750 |
| 4,214,246 | 7/1980 | Arechavala | 343/750 |

*Primary Examiner*—Eli Lieberman

*Assistant Examiner*—Michael C. Wimer

*Attorney, Agent, or Firm*—McGlew and Tuttle

[57] ABSTRACT

Emitting and receiving antenna system for accommodating all bands and frequencies and for operating selectively adjustably in resonance at a given emitting or receiving frequency, formed by one antenna component or two counterpart antenna components, each component containing therewithin a variable inductor and a variable capacitor, a drive mechanism for shifting the shiftable inductor part relative to the fixed inductor part of each such inductor for varying the inductance and conjointly for shifting the shiftable capacitor part relative to the fixed capacitor part of each such capacitor for varying the capacitance, and a control mechanism for controlling the drive mechanism for selectively shifting the corresponding shiftable parts conjointly for achieving selective antenna resonance tuning at an exact point corresponding to the desired operating band and frequency, such as with the shiftable inductor part and shiftable capacitor part of each antenna component being connected together for common shifting movement therewithin, and with the drive mechanism being enclosed within an antenna supporting housing and operated by a switch on a control desk or panel.

7 Claims, 2 Drawing Figures

TUNABLE ANTENNA WITH VARIABLE SERIES L-C NETWORK

FIELD AND BACKGROUND OF THE INVENTION

The present invention relates to improvements carried out in emitting and receiving antennas, particularly those used by ham operators, and achieving through the application of these antennas significant advantages of practical and functional performance, particularly with respect to the presently existing antenna types.

Conventional antennas are fixedly fitted to a corresponding frequency band, which means that there can be no other operation therewith but that at such a frequency, and additionally, as the system is a fixed one, it is difficult to maintain or stand by the exact point of the band at which operation is required.

SUMMARY OF THE INVENTION

These problems are perfectly resolved by way of the improvements of the present invention, which in effect and in accordance with its objects anticipates that such an antenna might spread over all bands and consequently all frequencies, and accordingly renders the antenna adjustable so that it can be fitted or maintained at or on the exact point of the band at which operation is intended, thereby enabling maximum efficiency to be achieved at any given or selected operating frequency, i.e. within the physical dimensions or constructional limits of the antenna itself.

The above objects and results are very simply and economically achieved according to the present invention by making a control desk panel available which is capable of driving a motor which upon being activated against any antenna sector can vary or adjust its inductance and capacitance until any such operating band and frequency chosen is reached.

BRIEF DESCRIPTION OF THE DRAWINGS

For a better understanding of the description in the present specification, the accompanying drawings show a practical and preferred embodiment by way of illustrative or non-exhaustive example of the scope of the present invention.

In the drawings.

DESCRIPTION OF THE PREFERRED EMBODIMENTS

Figure 1:
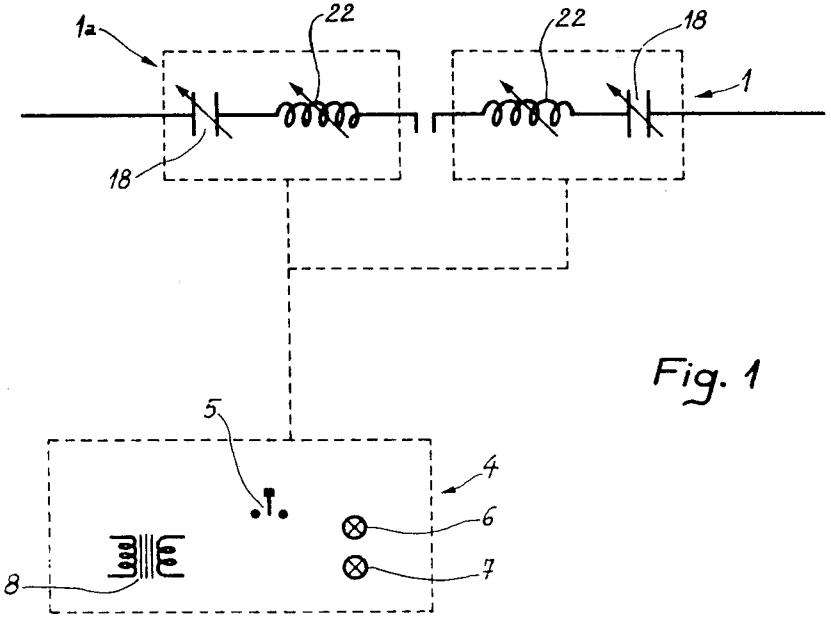
FIG. 1 is an electrical diagram of the components of an antenna wherein the present improvements have been applied.

According to the figures, the improvement in the emitting-receiving antennas, which embrace the objects of the present invention, are related to the fact that each antenna component or arm 1 and its twin component or arm 1*a* can optionally be driven by a motor M and a reducer R operatively connected to said components and enclosed within a box 2 by means of the associated lid 2' and which box comprises the support or base housing of the antenna unit, an assembly bushing 3 in a center bar being arranged thereat from which the different passive and radiating or radiant components feasibly variable in number extend or are brought out. The present system then is applicable to any single component type antennas, such as a dipole antenna, of any given operating frequency and power, and to multiple component type antennas as well as to vertical antennas and those called loop antennas.

For the operation or performance of said motor, there is provided a control panel 4 having a motor switch 5 for motor M, limit indicator 6,7 and a supply transformer 8. The power supply can be direct or alternating current from 6 to 220 volts according to the antenna components and the application intended.

The central panel 4 can also have controls for power and volume changes according to the antenna power pattern and dimension, and can include other components such as those for providing fine tuning, automatic fitting to predetermined frequencies, built-in supply sources and all the indicators associated with the entirety of the functions performed by equipment connected to the antenna according to the frequency and power pattern to be utilized.

Figure 2:
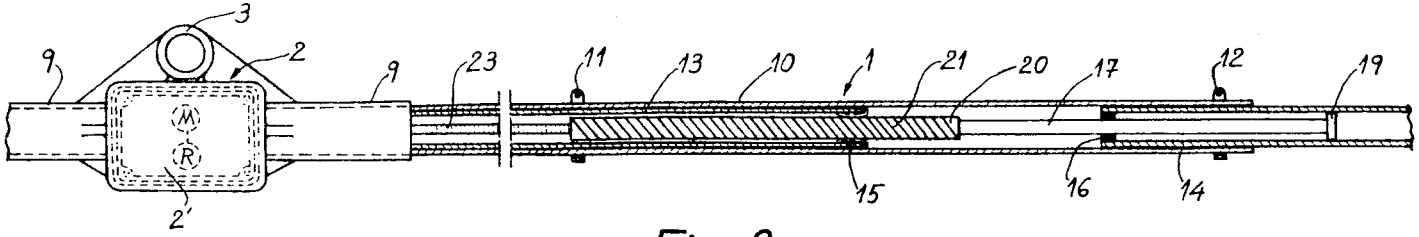
FIG. 2 is an elevation detail and practical cross-sectional view of an antenna component with its support and the starting pointer of its associated twin component.

As shown in FIG. 2, the box 2 carries a coupling bushing 9 for each antenna component or arm 1 and 1*a*, provided with an outer plastic non-conductive pipe 10 which supports via flanges 11,12 thereon two separate inner conductive aluminum pipes 13,14 within the outer plastic pipe 10, the first pipe 13, connected to the transmission line in the usual way, being covered or topped with friction metal runners 15 and the second pipe 14, at the remote or rear end of the component, being provided with a plastic internal or inside bearing bushing 16 at its end adjacent pipe 13 for the longitudinal or axial guidance of the antenna end stud 17, which determines the capacitance of its variable capacitor 18 (FIG. 1), i.e. upon shifting of stud 17 axially relative to the second pipe 14 that acts as the fixed capacitor part. The stud 17 is rod-like and also carries a centering element 19 at its remote or free end.

In turn, the tubular length portion 20, which is located medially of the antenna stud 17 relative to the coupling bushing 9 and which receives the end stud 17 therein, carries the longitudinally or axially shiftable coil 21, as shiftable inductor part, for determining the inductance of the variable inductance element 22 and which belongs to its active part, i.e. the outer portion starting from the friction runners 15.

In the longitudinal or axial shifting of such a stud and tubular portion arrangement 17,20, wherein the shiftable inductor coil 21 and capacitor stud 17 are series connected (see FIG. 1), and which thereby determines any variations in the particular antenna component inductance and capacitance, the free end of the stud tubular portion 20 is actuated when the helical bars or screws 23 are rotated or driven by the motor, i.e. to retract or to extend each tubular portion 20 relative to its screw 23 depending on the direction of screw rotation, although such a relative shifting can be effected as well with a fixed coil and a shiftable internal or inside ferrite core or even by means of chromium-plated iron turns of a correspondingly fixed coil, fixed under tension at the mouth of the pipe 13 with advance or shifting by the corresponding turning of the coil 21.

Thus, the present invention provides an emitting and receiving antenna system for accommodating all operable bands and frequencies within a given range and for operating selectively adjustably in resonance at a given emitting or receiving frequency, comprising at least one antenna component 1 and/or 1*a* containing therewithin a variable inductor 22 having a fixed inductor part 15 and a shiftable inductor part 21 arranged for varying the inductance, and a variable capacitor 18 having a fixed capacitor part 14 and a shiftable capacitor part 17 arranged for varying the capacitance, e.g. with the shiftable inductor part and shiftable capacitor part connected together for common shifting movement, such as longitudinally or axially within and relative to the antenna component, per longitudinally or axially shiftable parts 20, 21 and 17 relative to longitudinally or axially fixed parts 23, 13, 15 and 14; plus drive means arranged for shifting conjointly such shiftable parts relative to such fixed parts; and control means arranged for controlling the drive means for selectively shifting conjointly said shiftable parts for achieving selective antenna resonance tuning at an exact point corresponding to the desired operating band and frequency.

The control means may thus include the control panel 4 having the motor control switch 5 for operating the drive means, e.g. motor M and its associated reducer R, as motor means protectively enclosed in the housing 2, with the helical bar 23 as helical means being drivable by the motor means and operatively arranged for common concordant shifting of the shiftable parts, e.g. parts 20, 21 and 17.

The antenna tuning range in this system is very wide and an example can be given with an antenna for ham operators taking over from 1.5 Mc to 30 Mc in a continuous tuning.

The antenna unit is designed to be perfectly sealed and premature aging is avoided and obviously guaranteed, and all the models of the antennas manufactured in accordance with the instant specification may carry the conventional supports for a mast up to 60 mm. diameter, estimated to stay up and be resistant to wind speeds higher than 100 km/h.

The present invention in terms of its above noted essentials can be practically provided in other and further embodiments, only differing in detail with the one shown and disclosed above by way of example, all without departing from the present invention. Therefore, these various improvements can be embodied with any desired suitable means and accessories as all of them are contemplated within the scope of the following claims.

I claim:

1. Emitting and receiving antenna system for accommodating all bands and frequencies within a given range and for operating selectively adjustably in resonance at a given emitting or receiving frequency, comprising:

at least one antenna component containing therewithin a variable inductor having a fixed inductor part and a shiftable inductor part arranged for selectively varying the inductance upon selectively shifting the shiftable inductor part relative to the fixed inductor part, and a variable capacitor having a fixed capacitor part and a shiftable capacitor part arranged for correspondingly selectively varying the capacitance upon correspondingly selectively shifting the shiftable capacitor part relative to the fixed capacitor part.

drive means arranged for shifting the shiftable inductor part relative to the fixed inductor part and conjointly for shifting the shiftable capacitor part relative to the fixed capacitor part, and control means arranged for controlling the drive means for selectively shifting the shiftable inductor part and the shiftable capacitor part conjointly for achieving selective antenna resonance tuning at an exact point corresponding to the desired operating band and frequency, the inductor and capacitor being arranged in longitudinal end to end relation within said at least one antenna component, and including an inductor friction runner part and an inductor coil part in operative friction contact therewith, one of which inductor parts is fixed and the other of which is longitudinally shiftable relative thereto, and a capacitor outer concentric tubular part and a capacitor inner concentric stud part in radially spaced relation to each other whereby to form corresponding capacitor plates, one of which capacitor parts is fixed and the other of which is longitudinally shiftable relative thereto, the shiftable inductor part and the shiftable capacitor part being electrically connected in series and mechanically connected for common shifting movement, and the fixed inductor part and the fixed capacitor part being electrically insulated from each other, whereby upon shifting the corresponding shiftable parts relative to the corresponding fixed parts the inductance and capacitance will be varied directly and the frequency will be varied inversely.

2. System of claim 1, wherein the inductor friction runner part and the capacitor outer concentric tubular part are the fixed parts, and the inductor coil part and the capacitor inner concentric stud part are the longitudinally shiftable parts.

3. System of claim 1, wherein the control means includes a control panel having motor control switch means for operating the drive means, the drive means includes motor means and rotatable helical screw means drivable by the motor means and which are operatively arranged for common concordant shifting of the shiftable inductor part and the shiftable capacitor part.

4. System of claim 1, including an antenna supporting housing, said system comprising two counterpart antenna components each containing therewithin a said variable inductor and a said variable capacitor, and each being supported by said housing, and the drive means are enclosed in the housing and arranged for corresponding shifting of the shiftable inductor part and the shiftable capacitor part of each of said antenna components simultaneously.

5. Emitting and receiving antenna system for accommodating all bands and frequencies within a given range and for operating selectively adjustably in resonance at a given emitting or receiving frequency, comprising:

at least one antenna arm containing therewithin a variable inductor having a fixed inductor part in the form of a first conductive pipe and a shiftable inductor part in the form of a coil arranged for selectively varying the inductance upon selectively shifting the shiftable inductor part relative to the fixed inductor part, and a variable capacitor having a fixed capacitor part in the form of a second conductive pipe and a shiftable capacitor part in the form of a rod-like stud arranged for correspondingly selectively varying the capacitance upon correspondingly selectively shifting the shiftable capacitor part relative to the fixed capacitor part, said stud being fixed to said coil;

said first and second pipes being fixed to each other with said stud movable in said second pipe;

a centering element connected to said stud and slidably engaged with said second pipe for centering said stud in said second pipe;

drive means arranged for shifting the shiftable inductor part relative to the fixed inductor part and conjointly for shifting the shiftable capacitor part relative to the fixed capacitor part; and control means arranged for controlling the drive means for selectively shifting the shiftable inductor part and the shiftable capacitor part conjointly for achieving selective antenna resonance tuning at an exact point corresponding to the desired operating band and frequency.

6. System of claim 5, wherein the control means includes a control panel having motor control switch means for operating the drive means, the drive means includes motor means and rotatable helical screw means drivable by the motor means and operatively connected to the connected together shiftable inductor part and shiftable capacitor part for shifting the shiftable inductor and capacitor parts.

7. System of claim 5, including an antenna supporting housing, said system comprising two counterpart antenna arms connected to said housing and each containing therewithin a said variable inductor and a said variable capacitor, and each being supported by said housing, and the drive means are enclosed in the housing and arranged for corresponding shifting of the shiftable inductor part and the shiftable capacitor part of each of said antenna components.

* * * * *